US012295490B2

(12) United States Patent
Woolman et al.

(10) Patent No.: US 12,295,490 B2
(45) Date of Patent: May 13, 2025

(54) MOUNTABLE SHELF SYSTEM

(71) Applicant: SHURTECH BRANDS, LLC, Avon, OH (US)

(72) Inventors: Daniel Woolman, London (GB); Stuart Woolman, Charlotte, NC (US); Heidi Carrion, Avon, OH (US)

(73) Assignee: Shurtape Technologies, LLC, Avon, OH (US)

( * ) Notice: Subject to any disclaimer, the term of this patent is extended or adjusted under 35 U.S.C. 154(b) by 77 days.

(21) Appl. No.: 18/019,229

(22) PCT Filed: Aug. 13, 2021

(86) PCT No.: PCT/US2021/045835
§ 371 (c)(1),
(2) Date: Feb. 1, 2023

(87) PCT Pub. No.: WO2022/036161
PCT Pub. Date: Feb. 17, 2022

(65) Prior Publication Data

US 2023/0270251 A1 Aug. 31, 2023

Related U.S. Application Data

(60) Provisional application No. 62/706,400, filed on Aug. 14, 2020.

(51) Int. Cl.
*A47B 96/02* (2006.01)
*A47B 96/06* (2006.01)

(52) U.S. Cl.
CPC ..... *A47B 96/021* (2013.01); *A47B 96/06* (2013.01)

(58) Field of Classification Search
CPC ... A47B 96/021; A47B 96/027; A47B 96/028; A47B 96/06; A47B 96/061; A47B 96/066; A47B 96/067
See application file for complete search history.

(56) References Cited

U.S. PATENT DOCUMENTS 4,277,122 A 7/1981 Bargiel
2003/0070381 A1 4/2003 Hawang
(Continued)

FOREIGN PATENT DOCUMENTS

EP 0093180 A1 * 11/1983
GB 1270569 A * 4/1972
WO 2019169439 A1 9/2019

OTHER PUBLICATIONS

International Search Report for Application No. PCT/US2021/045835, mailed Nov. 26, 2021, 3 pages.

*Primary Examiner* — Matthew W Ing
(74) *Attorney, Agent, or Firm* — Lippes Mathias LLP

(57) ABSTRACT

A wall mountable shelving system that includes a back panel, and shelf panel, and at least one fastener for securing the back and shelf panels together. In a mounted configuration, the back panel is generally vertically oriented and the shelf panel is generally horizontally oriented. Surfaces of the back and shelf panels may form a 90 degrees angle. However, it is also possible for slight variance (e.g., 85-95 degrees, 87-93 degrees, 89-91 degrees). A wall-facing surface of the back panel may include a mounting bracket or base or may be configured to slide over or otherwise be secured to a mounting bracket or base already installed at the wall. The back panel may include a plastic material, optionally reinforced with a filler (e.g., glass fibers). The shelf panel may be unitary or include multiple pieces.

20 Claims, 9 Drawing Sheets

(56) References Cited

U.S. PATENT DOCUMENTS

| | | | | |
|---|---|---|---|---|
| 2009/0224119 | A1* | 9/2009 | Heffernan | A47B 96/066<br>248/220.21 |
| 2009/0230069 | A1* | 9/2009 | Naden | A47B 96/025<br>211/144 |
| 2012/0018396 | A1 | 1/2012 | Susan | |
| 2012/0118774 | A1* | 5/2012 | Loth | B65D 81/054<br>53/472 |
| 2019/0092528 | A1* | 3/2019 | Slattery | B65D 81/3813 |

* cited by examiner

MOUNTABLE SHELF SYSTEM

This application claims the priority benefit of U.S. Provisional Application No. 62/706,400 filed Aug. 14, 2020 and titled "MOUNTABLE SHELF SYSTEM," which is incorporated by reference in its entirety.

BACKGROUND

The present disclosure relates to a mountable shelf system and template.

Bottom-supported shelving units may be difficult and/or expensive to ship, assemble, and move. Floating or wall-mounted shelving units are less cumbersome. However, they may be difficult to assemble and properly mount to the wall.

There is a need for an easily wall-mountable shelf system.

BRIEF DESCRIPTION

The present disclosure relates to a wall mountable shelving system.

The system includes a back panel, and shelf panel, and at least one fastener for securing the back and shelf panels together. In a mounted configuration, the back panel is generally vertically oriented and the shelf panel is generally horizontally oriented. Surfaces of the back and shelf panels may form a 90° angle. However, it is also possible for slight variance (e.g., 85-95°, 87-93°, 89-91°).

A wall-facing surface of the back panel may include a mounting bracket or base or may be configured to slide over or otherwise be secured to a mounting bracket or base already installed at the wall.

The back panel may include a plastic material, optionally reinforced with a filler (e.g., glass fibers).

The shelf panel may be unitary or include multiple pieces. In some embodiments, the shelf panel includes a lower panel and an upper panel. The lower panel may include a plastic material, optionally reinforced with a filler (e.g., glass fibers). The upper panel may include an elastomeric material. The upper panel surface may include surface patterning or roughness to reduce sliding. The upper panel surface may include an outer lip along at least one edge for retaining items placed on the shelf. In some embodiments, the lip extends along an edge of the upper panel surface opposite the back panel.

The back panel may include a first side recess and a second side recess. The shelf panel may include a third side recess and a fourth side recess. The at least one fastener may include a first fastener and a second fastener. The first fastener may be sized and shaped to occupy the first and third recesses. The second fastener may be sized and shaped to occupy the second and fourth recesses. The first and second fasteners may be L-shaped (e.g., steel angle braces).

In some embodiments, the side fasteners fit entirely within the recesses. However, in other embodiments, only a portion (e.g., half) of a side fastener fits within the recesses of a first shelf assembly and a remaining portion fits within recesses of a second shelf assembly. The modular design allows a plurality of shelf assemblies to be connected to form a longer shelf system.

The back panel may include a ledge extending away from the surface of the back panel opposite the wall-facing surface. The upper surface of the ledge and a lower surface of the shelf panel may include complementary mating features. For example, the ledge may include at least one channel and the shelf panel may include at least one complementary feature sized and shaped to fit within the at least one channel. The shelf panel may also or alternatively include at least one clip and the ledge may also or alternatively include at least one recess configured to receive at least one clip.

Also disclosed are packaged shelf systems including a container and within the container: a back panel comprising a ledge, a first side recess, and a second side recess; a shelf panel comprising a non-slip surface, a third side recess, and a fourth side recess; a first L-shaped fastener configured to mate resiliently with the first side recess and the third side recess; and a second L-shaped fastener configured to mate resiliently with the second side recess and the fourth side recess.

The shelf panel may reside on the ledge, a first straight portion of the first L-shaped fastener may extend between the shelf panel and the ledge on a first side, and a second straight portion of the second L-shaped fastener may extend between the shelf panel and the ledge on a second side.

In some embodiments, the system further includes at least one base or bracket for mounting the shelf system to a wall.

The back panel may include a wall-facing surface configured to be slide over the at least one base or bracket.

In some embodiments, the at least one base or bracket is visible through a transparent window of the container.

Methods for packing and/or assembling the shelf systems are also disclosed.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1A:
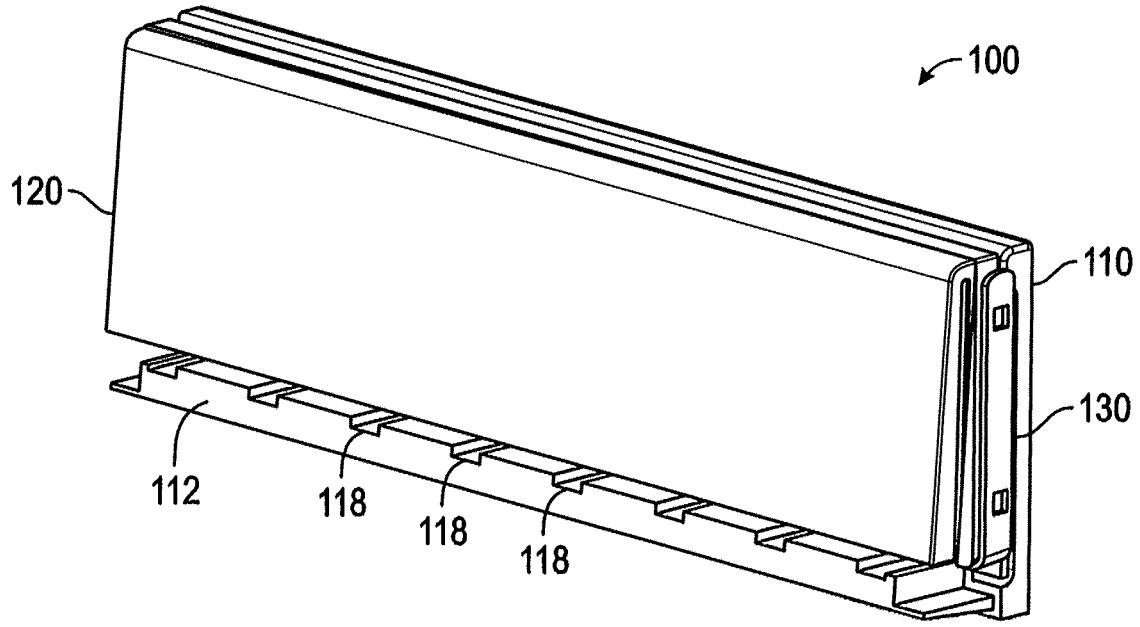
FIG. 1A is a front perspective view of a shelf system in a shipping configuration in accordance with some embodiments of the present disclosure.

The present disclosure may be understood more readily by reference to the following detailed description of desired embodiments included therein. In the following specification and the claims which follow, reference will be made to a number of terms which shall be defined to have the following meanings.

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent can be used in practice or testing of the present disclosure. All publications, patent applications, patents, and other references mentioned herein are incorporated by reference in their entirety. The materials, methods, and articles disclosed herein are illustrative only and not intended to be limiting.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases that require the presence of the named ingredients/steps and permit the presence of other ingredients/steps. However, such description should be construed as also describing compositions, mixtures, or processes as "consisting of" and "consisting essentially of" the enumerated ingredients/steps, which allows the presence of only the named ingredients/steps, along with any impurities that might result therefrom, and excludes other ingredients/steps.

Unless indicated to the contrary, the numerical values in the specification should be understood to include numerical values which are the same when reduced to the same number of significant figures and numerical values which differ from the stated value by less than the experimental error of the conventional measurement technique of the type used to determine the particular value.

All ranges disclosed herein are inclusive of the recited endpoint and independently combinable (for example, the range of "from 2 to 10" is inclusive of the endpoints, 2 and 10, and all the intermediate values). The endpoints of the ranges and any values disclosed herein are not limited to the precise range or value; they are sufficiently imprecise to include values approximating these ranges and/or values.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The present disclosure relates to a wall mountable shelf system. The shelf system packs flat with insertion places for components for more efficient shipping and merchandising. The shelf system is easily assembled using fasteners (e.g., L-shaped stainless steel braces) to connect to plastic parts. A wall facing surface of one of the plastic parts may be configured to slide over one or more mounting bases or braces secured to a wall in advance.

Figure 1B:
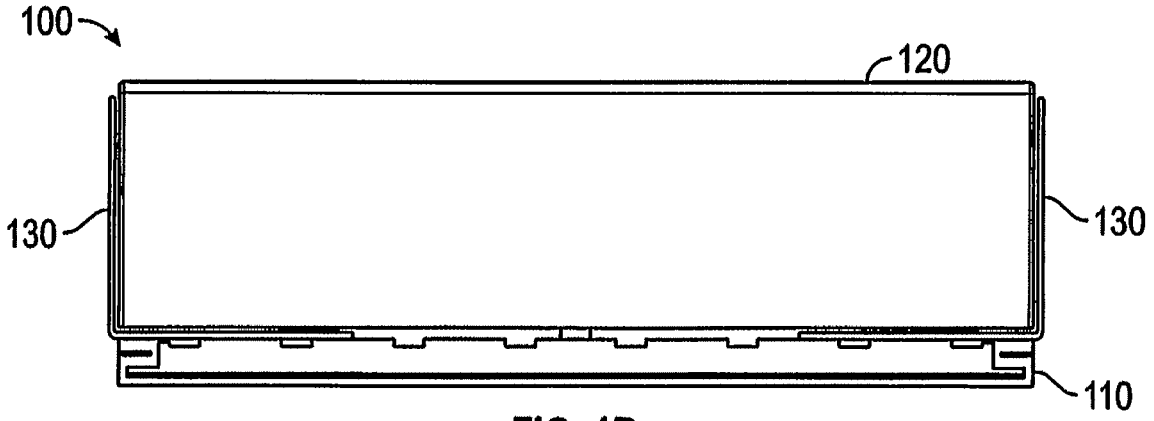
FIG. 1B is a front view of the shelf system of FIG. 1A.
Figure 1C:
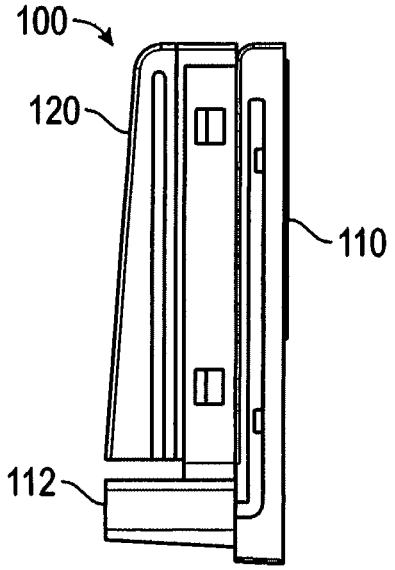
FIG. 1C is a side view of the shelf system of FIGS. 1A-B.

FIGS. 1A-C illustrates a shipping configuration of a mountable shelf system 100 in accordance with some embodiments of the present disclosure. As shown, the system 100 can be packed in a thin container due to the shapes of the components. For example, a system 100 with an assembled depth of 80 mm may have dimensions of 100 mm×310 mm×35 mm. The system 100 includes a back panel 110, a shelf panel 120, and fasteners 130. The back panel includes a ledge 112 with recesses 118. In the shipping configuration, the shelf panel 120 fits on the ledge 112.

Figure 2:
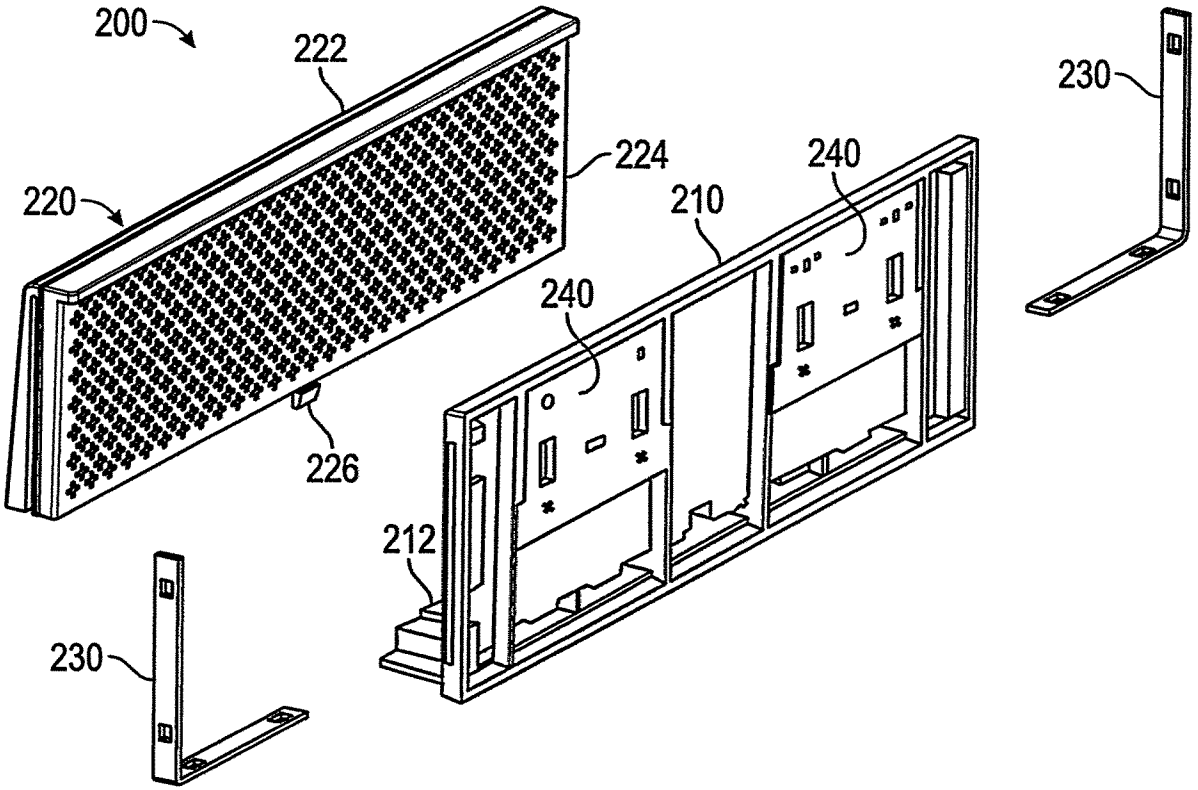
FIG. 2 is an exploded view of the shelf system of FIGS. 1A-C.

FIG. 2 is an exploded view of the system of FIGS. 1A-C. The system 200 includes a back panel 210 with a ledge 212, mounting braces or brackets 240, shelf panel 220, and L-shaped fasteners 230. In this shipping configuration, the shelf panel 220 resides of the ledge 212 and one of the straight portions of each fastener 230 fits between the panels 210, 220. The shelf panel 220 includes lower layer 222 and upper layer 224. The lower layer 222 includes a clip 226 for mating with a recess in the ledge 212 (not shown).

Figure 3:
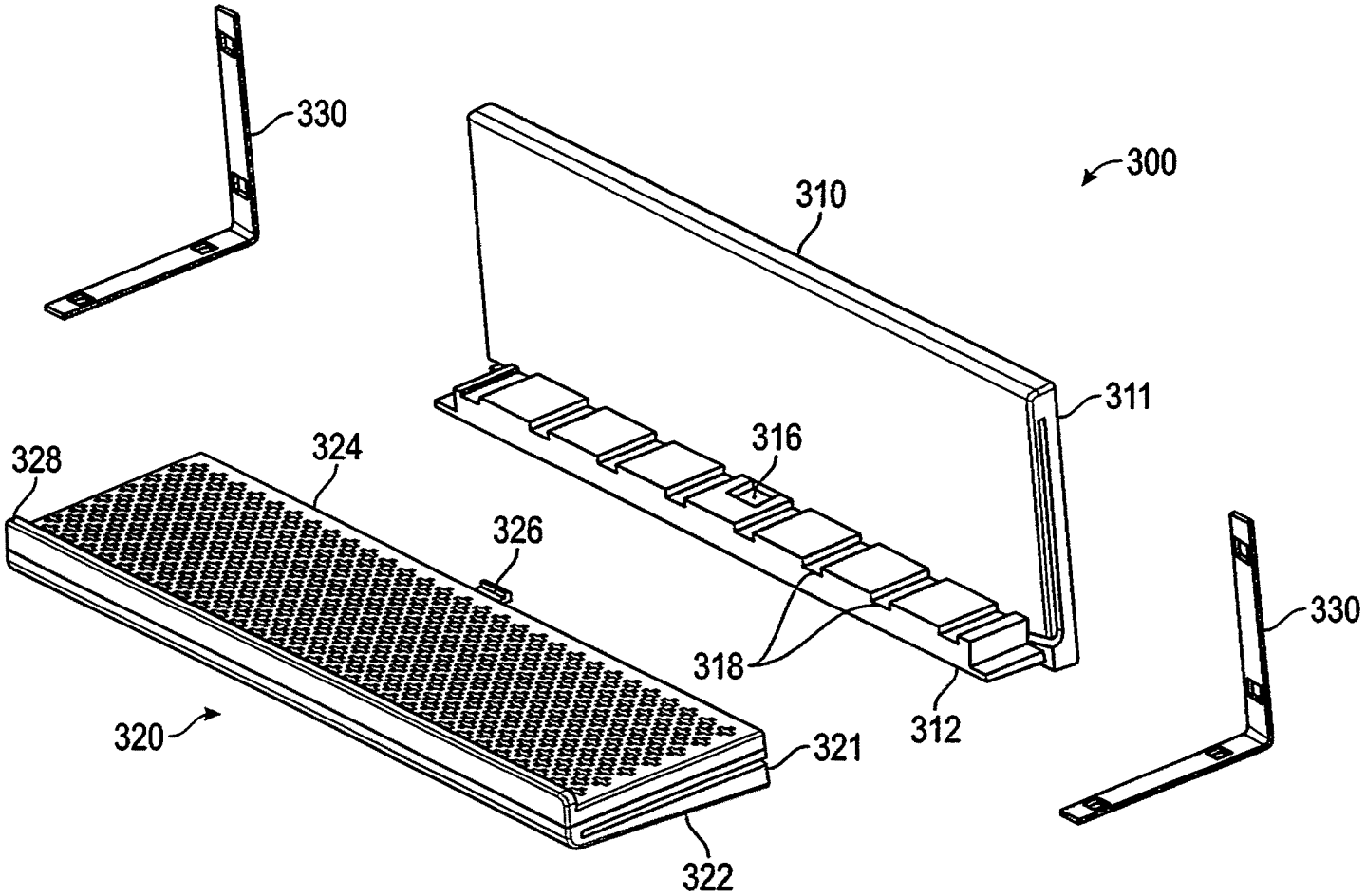
FIG. 3 is an exploded view of a shelf system in a mountable configuration in accordance with some embodiments of the present disclosure.

FIG. 3 is an exploded view of a mountable shelf system 300 in a mountable configuration. The system 300 includes a back panel 310, a shelf panel 320, and fasteners 330. The back panel 310 includes a ledge 312 having a plurality of channels 318 and a recess 316. The back panel 310 further includes a side recess 311 (and a similar recess on the opposite side is not visible). The shelf panel 320 includes a lower layer 322 and an upper layer 324. The lower layer 322 includes a clip 326 which is complementary to the recess 316 in at least one of the shipping and mounting configurations. The lower layer 322 may further include features (not shown) which are complementary to the channels 318. The upper layer 324 may include one or more features to reduce the likelihood of items stored on the shelf from rolling or sliding off. The features may include surface patterning or roughness for increased friction and/or a lip 328 extending from a top surface thereof. The surface may be a non-slip grip surface. The lower layer 322 further includes a side recess 321 (and a similar recess on the opposite side is not visible). It is also possible for the side recess 321 to be located in the upper layer 324 or between the lower and upper layers 322, 324. These recesses are sized to receive the L-shaped fasteners 330. These fasteners 330 hold the panels together. In the mounting configuration, it is possible to use an adhesive composition with the fasteners and/or at an interface between the panels. It is also possible for the shelf panel to be a unitary one-piece structure instead of a multi-piece structure.

The fasteners may include a high strength material such as a metal (e.g., steel).

The lower layer and the back panel may include the same or different plastic materials (optionally reinforced with a filler material such as glass fibers). Non-limiting examples of plastic materials include polyamides, polycarbonates, polyolefins (e.g., polyethylene, polypropylene), acrylonitrile butadiene styrene (ABS) polymers, polyethylene terephthalate (PET), polybutylene terephthalate (PBT), and polyvinyl chloride (PVC).

The upper layer may include an elastomeric material. Non-limiting examples of elastomeric materials include polyisoprene, polybutadiene, chloroprene rubber, butyl rubber, styrene-butadiene rubber, nitrile rubber, ethylene propylene rubber (EPM), ethylene propylene diene rubber (EPDM), epichlorohydrin rubber, polyacrylic rubber, silicone rubber, fluorosilicone rubber, fluoroelastomers, perfluoroelastomers, polyether block amides, and chlorosulfonated polyethylene.

Figure 4:
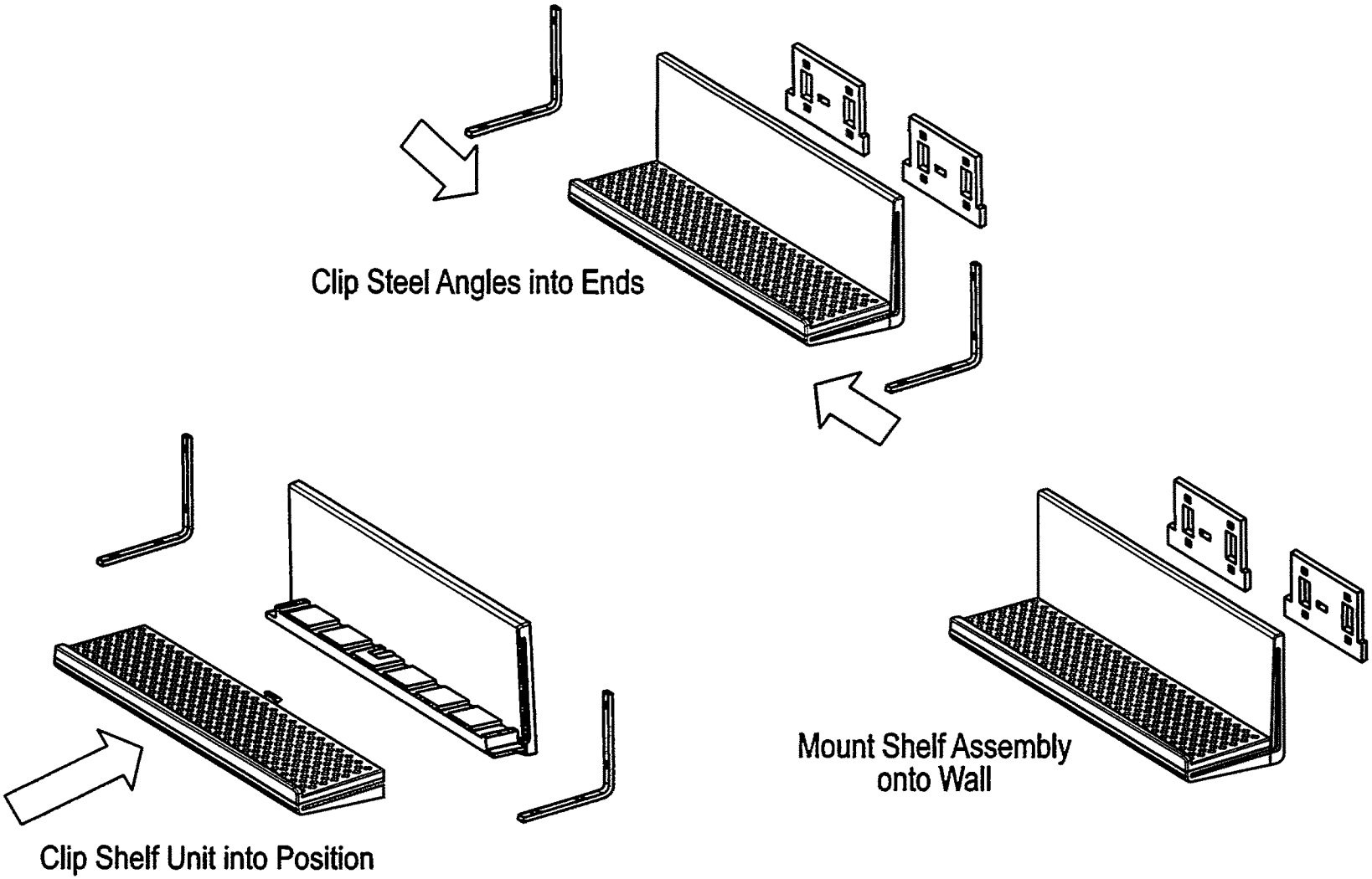
FIG. 4 is a schematic flow chart illustrating an assembly and mounting method in accordance with some embodiments of the present disclosure.

FIG. 4 illustrates an embodiment of a method for assembling and mounting the shelf system. In step 1, the shelf panel is clipped onto the ledge. In step 2, the L-shaped fasteners are inserted into the recesses to secure the panels together. In step 3, the shelf system is mounted onto the wall.

Figure 5:
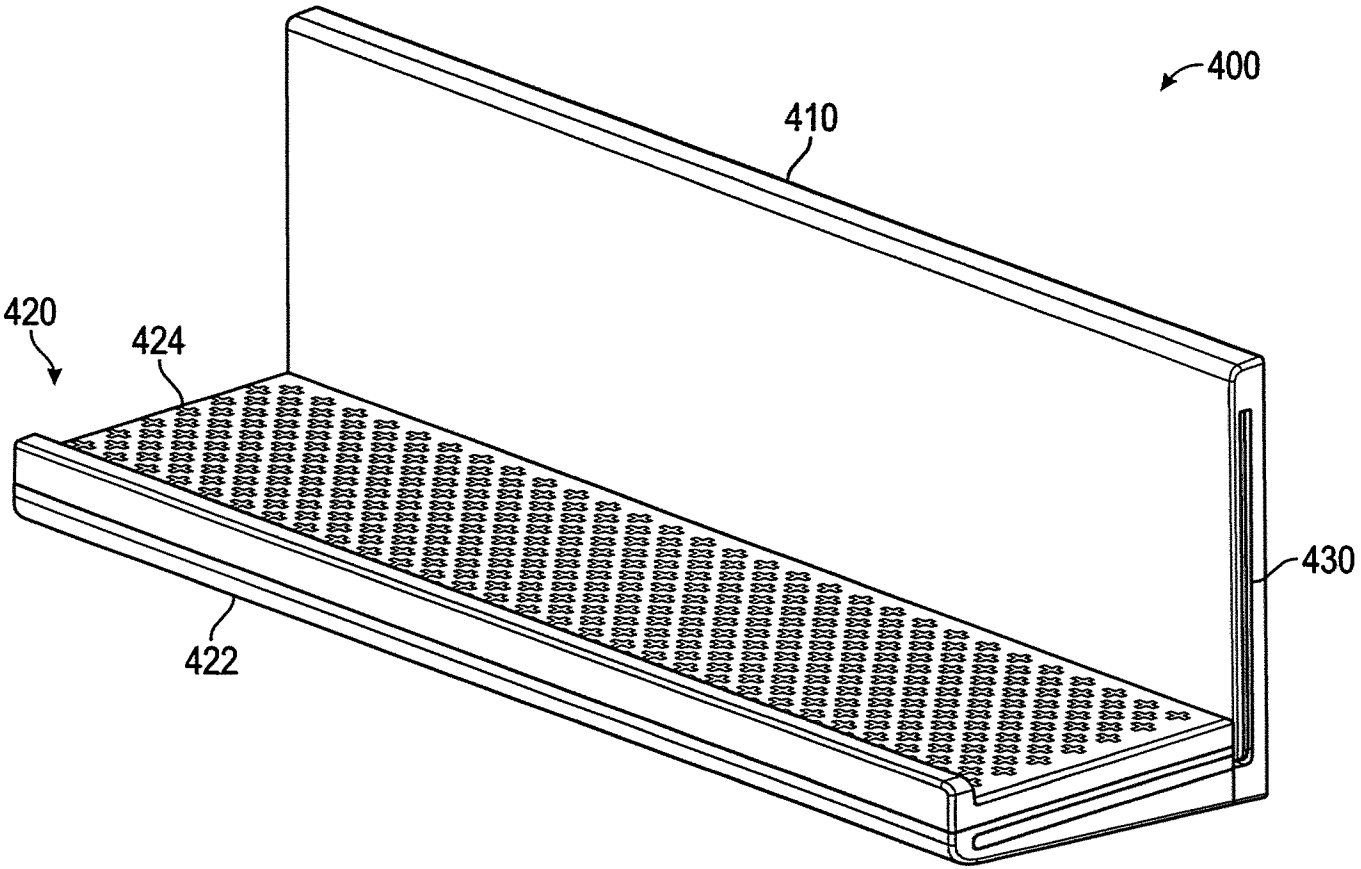
FIG. 5 is a front perspective view of an assembled shelf system in accordance with some embodiments of the present disclosure.

FIG. 5 illustrates an assembled shelf system 400. The system 400 includes back panel 410 and shelf panel 420 fastened together with fasteners 430. The shelf panel 420 includes a lower plastic layer 422 and an upper elastomeric layer 424.

Figure 6:
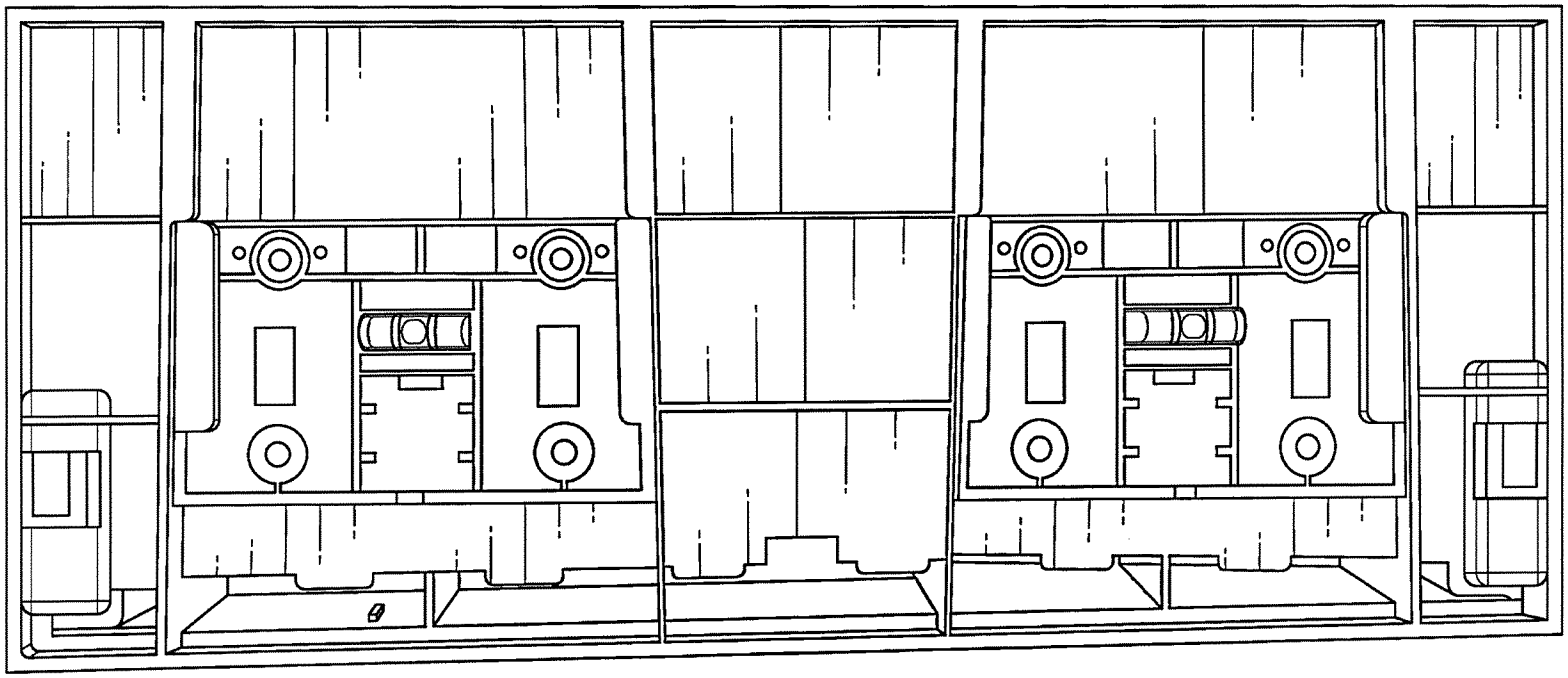
FIG. 6 is a drawing showing bases inserted in opposite orientation in accordance with some embodiments of the present disclosure.

FIG. 6 is a drawing of the rear surface of a back panel with mounting bases. The bases are inserted in the opposite orientation so that they're held in place for packaging. The packaging may include transparent windows so that these bases are visible.

Figure 7:
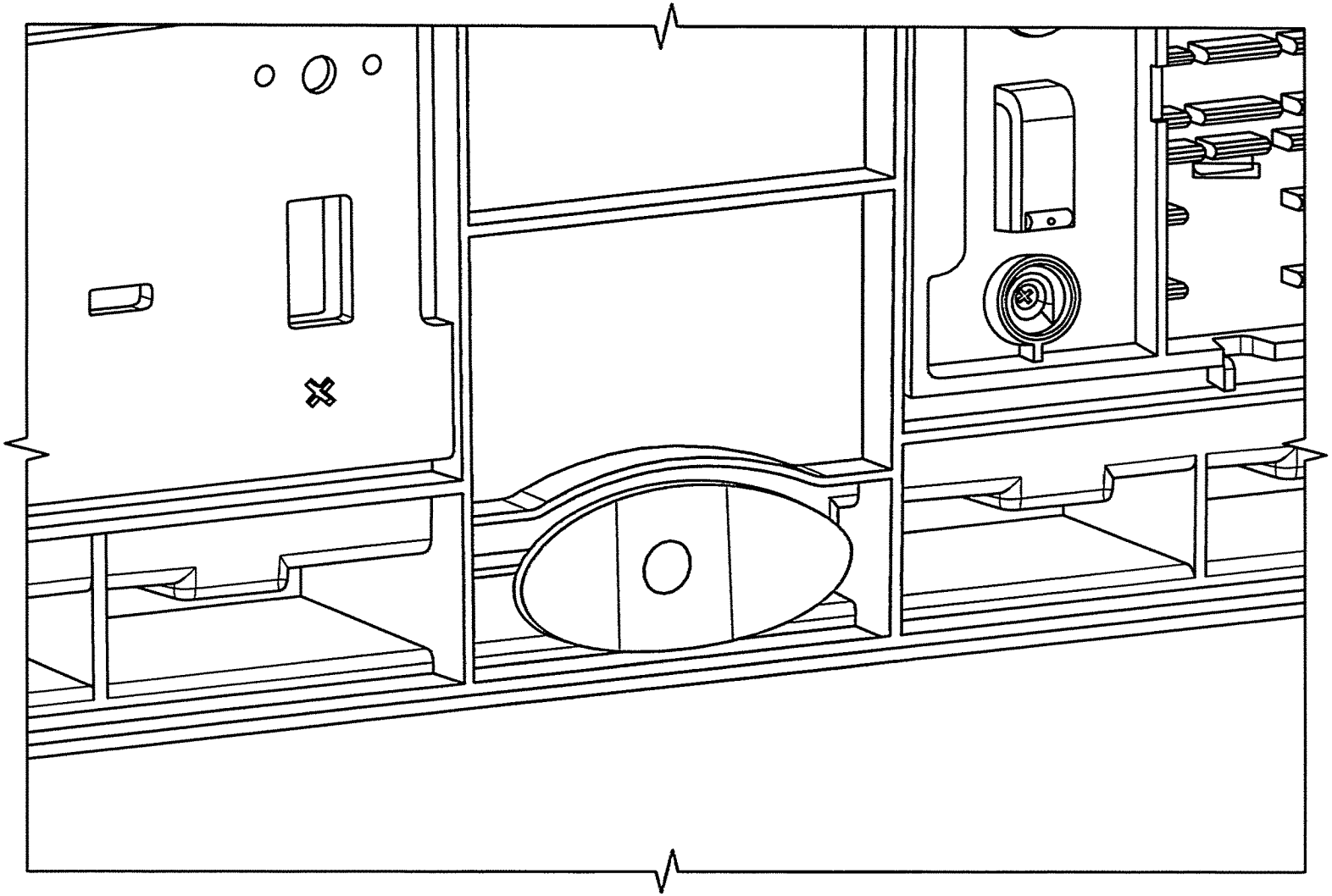
FIG. 7 is a zoomed in view of a rear surface of the back panel showing an inserted helper tool in accordance with some embodiments of the present disclosure.

FIG. 7 is a zoomed in view of a portion of the back panel showing an insertion location for a helper tool.

Figure 8:
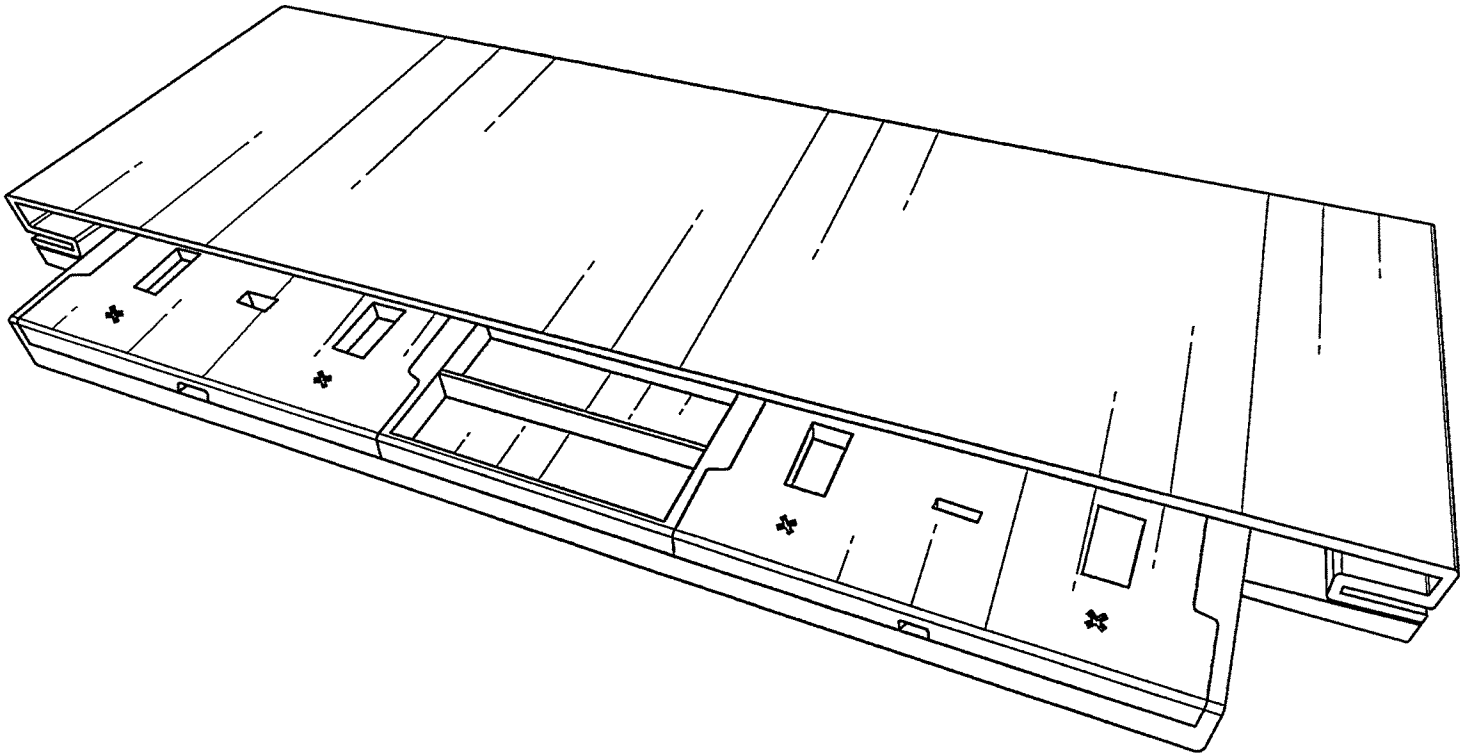
FIG. 8 is a drawing of a template sliding into a shelf in accordance with some embodiments of the present disclosure.

FIG. 8 is a photograph showing a template being inserted into a shelf.

In some embodiments, the fasteners fit fully within the side recesses of the plastic parts. However, in other embodiments, the fasteners extend partially out (e.g., 50%) of the recesses. In these embodiments, a plurality of modular shelf units may be connected to form the shelf system. For example, two shelf modules may be connected using an L-shaped fastener to form a longer shelf system. It is possible to include smaller fasteners for the ends of the shelf system and larger fasteners securing adjacent modules together. Where multiple shelf modules are connected to form a longer shelf system, each individual module may independently have the same length or a different length compared to every other module. Modules with different lengths may enhance the customizability of the overall length of the shelf system.

Non-limiting examples of mounting brackets and how they may be secured to walls (optionally using templates) are described in WO 2019/141969A1 to Woolman published Jul. 25, 2019 and U.S. Pat. No. 10,143,316 to Will et al. issued Dec. 4, 2018. The contents of these documents are incorporated by reference herein in their entireties.

The upper and lower layers of the shelf panel may be permanently secured to each other. In other embodiments, these layers are detachably attached. For example, the upper elastomeric layer may be removable and could be replaced with another elastomeric layer having a different color and/or texture.

The elastomeric material may be a thermoplastic elastomer. Non-limiting examples include styrenic block copolymers, thermoplastic polyolefinelastomers, thermoplastic vulcanizates, thermoplastic polyurethanes, thermoplastic copolyester, and thermoplastic polyamides.

The elastomeric material may be continuous or discontinuous on the surface. For example, the elastomeric material may be present in strips oriented perpendicular to the length of the shelf, parallel to the length of the shelf, or at an intermediate angle.

The system may include two bases per 12" of shelf length in some embodiments.

The bases may include an adhesive on at least one of a wall-facing surface and a back panel-facing surface.

Each base may include a level (e.g., a bubble level). Alternatively or additionally, a template used to achieve correct spacing between adjacent bases may include a level (e.g., a bubble level).

The template may include holes or transparent portions such that desired areas of the base are visible and/or readily accessible. For example, at least one level (e.g., a bubble level) of the base may be visible through the template to assist in applying the base to the wall properly. Alternatively or additionally, holes for screws, pins, or other fasteners in the base may be accessible through the template.

A process for securing the bases to a wall may include associating a template with a plurality (e.g., 2) bases, positioning the template at the wall, inserting fasteners through apertures in the template and bases to secure the bases to the wall, and removing the template (e.g., by sliding it over the bases). The shelf can then be attached to the wall (e.g., by sliding it over the bases).

The template may be aligned with a top surface of the base, a bottom surface of the base, or both the top and bottom surfaces of the base.

The template may be aligned with a top surface of the shelf assembly, a bottom surface of the shelf assembly, or both the top and bottom surfaces of the shelf assembly.

Two or more shelf assemblies may be attached to a wall at the same time by joining the assemblies together with a joiner piece (e.g., L-shaped fastener). The joined assemblies can then be installed on the wall as a single unit.

When the fasteners are L-shaped, they may be cut from a flat metal element (i.e., 2-dimensional) or cut from a bent metal element (i.e., 3-dimensional).

A process for installing multiple shelf assemblies can include using a template to align a first base with a second base, removing the template and shifting it over to align the second base with a third base, etc. Use of the template may assist in achieving correct spacing and alignment.

Figure 9:
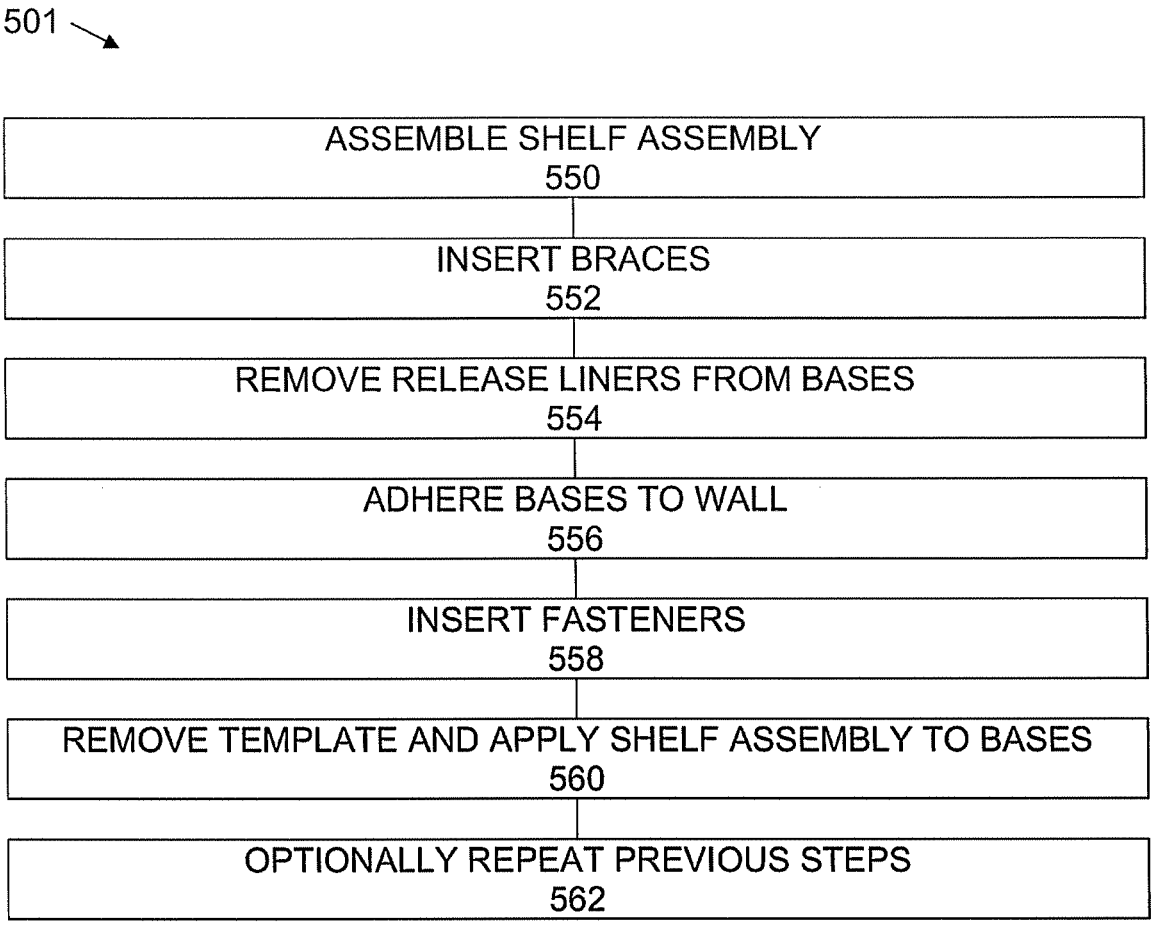
FIG. 9 is a flow chart illustrating a process for securing a shelf assembly to a wall in accordance with some non-limiting embodiments of the present disclosure.

FIG. 9 is a flow chart illustrating a process 501 for assembling and securing a shelf assembly to a wall in accordance with some non-limiting embodiments of the present disclosure. The process 501 includes assembling the shelf assembly 550, inserting braces 552, removing release liners from bases to expose an adhesive 554, adhering the bases to the wall 556, inserting pins or other fasteners into the wall through holes in the base 558, removing a template from the bases and applying the shelf assembly to the bases 560, and optionally applying a further shelf assembly by repeating these elements 562.

The assembling 550 includes joining the back panel and shelf panel. In some embodiments, the assembly is configured such that a click is audible when the panels are properly joined.

The braces may be inserted 552 through a rear surface of the back panel and extend into the shelf panel. The braces may be L-shaped. In some embodiments, the braces are not visible through the side surface(s) of the back panel and/or the shelf panel. In other embodiments, the braces are visible through the side surface(s). The braces may or may not extend through the side surface(s) (e.g., to allow an additional shelf assembly to be connected and lengthen the shelf).

The release liners may be removed 554 while the bases are in the template to expose an adhesive (e.g., a permanent adhesive).

Next, the bases are adhered to the wall 556 (e.g., a clean drywall surface). They may be adhered while a bubble level on the template is utilized for proper alignment. For example, the bases and/or template in the region of the bases may be pressed firmly for about 30 seconds.

Fasteners are inserted 558 into the wall through holes in the bases. The fasteners may be pins (e.g., six pins per base). In some embodiments, a magnetic pin helper is used to insert the pins. The fasteners used may depend on the wall surface. For example, screws may be utilized for a wooden surface.

The template is removed and the shelf assembly is applied to the bases 560. In other embodiments, the shelf assembly may be applied over the bases and template without removal of the template. The application may involve sliding the shelf assembly over the bases in a vertical direction (e.g., over the top) or a horizontal direction (e.g., from left to right or right to left).

Optionally, these steps are repeated 562 to apply additional shelf assemblies (e.g., to lengthen the shelf).

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A shelf system comprising:

a back panel comprising a ledge and a rear wall extending perpendicular to the ledge, a first side recess, and a second side recess, each recess formed in the rear wall;

a shelf panel comprising a non-slip surface, a third side recess, and a fourth side recess;

a first L-shaped fastener configured to mate resiliently with the first side recess and the third side recess; and a second L-shaped fastener configured to mate resiliently with the second side recess and the fourth side recess;

wherein in an assembled condition a first leg of each L-shaped fastener is horizontally oriented within the shelf panel and a second leg of each L-shaped fastener is vertically oriented in the rear wall.

2. The shelf system of claim 1, wherein the back panel comprises a plastic material.

3. The shelf system of claim 1, wherein the first L-shaped fastener and the second L-shaped fastener comprise stainless steel.

4. The shelf system of claim 1, wherein the shelf panel comprises a lower panel and an upper panel.

5. The shelf system of claim 4, wherein the lower panel comprises a plastic material and the upper panel comprises an elastomeric material.

6. The shelf system of claim 5, wherein the lower panel comprises the third side recess and the fourth side recess; and wherein the upper panel comprises the non-slip surface.

7. The shelf system of claim 1, where the ledge comprises a plurality of channels and the shelf panel comprises a plurality of features complementary to the plurality of channels.

8. The shelf system of claim 1, wherein the shelf panel comprises a clip and the ledge comprises a recess complementary to the clip.

9. The shelf system of claim 1, further comprising at least one base for securing the shelf system to a wall, wherein a rear surface of the back panel is configured to slide over the at least one base.

10. A packaged shelf system comprising a container and within the container:

a back panel comprising a ledge and a rear wall extending perpendicular to said ledge, a first side recess, and a second side recess, each recess formed in the rear wall;

a shelf panel comprising a non-slip surface, a third side recess, and a fourth side recess;

a first L-shaped fastener configured to mate resiliently with the first side recess and the third side recess; and a second L-shaped fastener configured to mate resiliently with the second side recess and the fourth side recess;

wherein each of said first, second, third, and fourth recess is located on distal ends of the respective rear wall and shelf panel such that the L-shaped fasteners are exposed to an external environment.

11. The system of claim 10, wherein the shelf panel resides on the ledge, a first straight portion of the first L-shaped fastener extends between the shelf panel and the ledge on a first side, and a second straight portion of the second L-shaped fastener extends between the shelf panel and the ledge on a second side.

12. The system of claim 10, further comprising at least one base or bracket for mounting the shelf system to a wall.

13. The system of claim 12, wherein the back panel includes a wall-facing surface configured to be slide over the at least one base or bracket.

14. The system of claim 12, wherein the at least one base or bracket is visible through a transparent window of the container.

15. The system of claim 10, wherein the shelf panel comprises a lower panel and an upper panel.

16. The system of claim 15, wherein the lower panel comprises a plastic material and the upper panel comprises an elastomeric material.

17. The system of claim 16, wherein the lower panel comprises the third side recess and the fourth side recess; and wherein the upper panel comprises the non-slip surface.

18. The system of claim 10, where the ledge comprises a plurality of channels and the shelf panel comprises a plurality of features complementary to the plurality of channels.

19. The system of claim 10, wherein the shelf panel comprises a clip and the ledge comprises a recess complementary to the clip.

20. The system of claim 10, wherein the first L-shaped fastener and the second L-shaped fastener comprise stainless steel.

* * * * *